US008389839B2

(12) United States Patent
McVicker

(10) Patent No.: US 8,389,839 B2
(45) Date of Patent: Mar. 5, 2013

(54) THUMB PICK

(76) Inventor: Richard McVicker, Indianapolis, IN (US)

( * ) Notice: Subject to any disclaimer, the term of this patent is extended or adjusted under 35 U.S.C. 154(b) by 30 days.

(21) Appl. No.: 13/015,017

(22) Filed: Jan. 27, 2011

(65) Prior Publication Data

US 2012/0192699 A1 Aug. 2, 2012

(51) Int. Cl.
*G10D 3/16* (2006.01)

(52) U.S. Cl. ..... 84/322

(58) Field of Classification Search ..... 84/322
See application file for complete search history.

(56) References Cited

U.S. PATENT DOCUMENTS

| | | | | | |
|---|---|---|---|---|---|
| 756,348 | A | | 4/1904 | Forney | |
| 1,787,136 | A | | 12/1930 | Beauchamp | |
| 2,045,571 | A | | 6/1936 | Dopyera | 84/422 |
| 2,063,011 | A | | 12/1936 | Bell | 84/322 |
| 3,112,668 | A | | 12/1963 | Moshay | 84/322 |
| 3,595,118 | A | | 7/1971 | Paxton | 84/322 |
| 3,699,838 | A | | 10/1972 | Montgomery | 84/322 |
| 4,102,234 | A | | 7/1978 | Brundage | 84/322 |
| 4,270,433 | A | * | 6/1981 | Adamec | 84/322 |
| 4,625,616 | A | | 12/1986 | McVicker | 84/322 |
| 4,867,032 | A | * | 9/1989 | Lukehart | 84/322 |
| 5,509,341 | A | | 4/1996 | Dunlop | 84/322 |
| D370,687 | S | | 6/1996 | Sarno | D17/20 |
| D385,293 | S | | 10/1997 | Sarno | D17/20 |
| 5,856,627 | A | | 1/1999 | George | 84/322 |
| 5,981,857 | A | * | 11/1999 | Mapson | 84/322 |
| 6,335,477 | B1 | | 1/2002 | Miller | 84/322 |
| 6,686,522 | B2 | | 2/2004 | Won et al. | 84/291 |
| 6,737,569 | B2 | | 5/2004 | Kees | 84/322 |
| 6,797,871 | B2 | | 9/2004 | Atkin | 84/322 |
| D519,149 | S | | 4/2006 | Ball | D17/20 |
| 7,157,635 | B2 | * | 1/2007 | Sogabe | 84/320 |
| 7,179,976 | B2 | | 2/2007 | West | 84/322 |
| 7,312,386 | B2 | | 12/2007 | Sielaff et al. | 84/320 |
| D603,891 | S | | 11/2009 | Whetstine | D17/20 |
| D626,170 | S | | 10/2010 | McNeely | D17/20 |

OTHER PUBLICATIONS http://www.strum-n-comfort.com/crossoverpickproducts.html.

* cited by examiner

*Primary Examiner* — Christopher Uhlir
(74) *Attorney, Agent, or Firm* — Brinks Hofer Gilson & Lione

(57) ABSTRACT

A thumb pick formed as a unitary one-piece body having a substantially inflexible pick point portion including at least one slot extending between an upper surface and a lower surface of the pick point portion. A pliable strap portion extends away from the pick point portion toward a tail portion including a terminal end. The pliable strap portion is designed to wrap around a musician's thumb, while the tail portion becomes engaged in the slot with the tail portion confined between the upper and lower surfaces of the pick point portion. A gusset can be included on an upper surface of the pick point portion to strengthen the inflexibility of the pick point portion. The tail portion of the strap can include a series of grooves while the slot includes a pawl designed to engage at least one of the series of grooves to secure the strap within the slot.

21 Claims, 3 Drawing Sheets

THUMB PICK

BACKGROUND

The present disclosure is directed to picks for stringed instruments, and particularly to picks designed to be attached to a musician's thumb for use on such instruments as banjos, dobros, mandolins, pedal steels, guitars, etc.

A commonly employed thumb pick is formed of a single continuous loop of metal or stiff plastic to engage the thumb having a projecting pick point intended to contact the strings of an instrument. Examples of such thumb picks are illustrated in U.S. Pat. Nos. 1,787,136 and 5,509,341 as well as in U.S. Design Pat. No. D603,891. A discussion of the shortcomings of such thumb picks appears in connection with FIG. 1 of my earlier U.S. Pat. No. 4,625,616. These picks are designed to maintain their stiffness throughout the life of the pick and consequently cannot be worn for a great length of time since they often exert great pressure in the area of the cuticle of the nail. Since the retention of this type of thumb pick on the thumb requires a constant compression, it must be of an inflexible material. Generally, the pick point is cantilevered from the bottom center of the thumb, although the pick point itself may have a variety of known shapes. This existing type of pick tends to be unidirectional and only stays in its proper location on the thumb when strings are stuck with a downward stroke of the thumb. Should the pick catch on a string or other object while the thumb is moving in an upward motion, the pick can become misaligned and can even come off the thumb entirely.

The thumb pick of my earlier patent is, by contrast, formed from a softer thin malleable planar sheet of material which is deformable out of the plane of the material. The material is soft enough and heat pliable enough to allow the thumb shape and the body temperature to dictate the shape of the pick. The thumb pick includes a string-engaging portion and an integral main body portion that includes three straps that are movable between the substantially planar dormant position and a bowed thumb-receiving position in which the center strap is displaced away from the outer two straps to define a thumb-receiving passageway. The string-engaging portion is positioned to extend transversely to the axis of the thumb and in a plane that is common to that axis. The softer malleable material is more comfortable to wear than the more conventional thumb picks. Advantageously, the pick design permits a musician to stroke the strings on the up-stroke or return stroke without the pick being displaced from the thumb, thereby increasing the number of times the pick can contact a string per stroke of the thumb. The malleable character of the pick material allows the pick to be quickly returned to a flat plane after being removed from the musician's thumb to allow the pick to be stored in a substantially flat condition in a holder, wallet, or pocket, or for use in a flat state as a conventional guitar pick to be held between the thumb and first finger.

Despite the comfort and flexibility provided by my earlier thumb pick, the soft character of the pick point portion was viewed by some string musician's as being undesirable, particularly by those who play instruments having heavier weight strings. Others have sometimes criticized the range of sizes required and the volume of material exposed on the end of the pick opposite the pick point, which sometimes can contact the musician's index finger while playing. There is therefore a need for a thumb pick that includes the comfortable thumb engaging characteristics of my earlier pick while having a more robust pick point that can be used successfully even by those who play instruments having heavier weight strings and avoiding the interference with the musician's index finger.

SUMMARY

A thumb pick can be defined by a unitary one-piece body having a substantially inflexible pick point portion, and a strap portion extending away from the pick point portion. The strap portion is designed to wrap around a musician's thumb, while the pick point portion includes an outwardly projecting tip designed to engage a string of a stringed instrument.

In one embodiment, a gusset can be located on and extend upward from a surface of the pick point portion. The gusset can be sized to provide pick point portion with a desired degree of inflexibility. The pick point portion can include a planar lower surface, while the gusset can be situated on an upper surface of the pick point portion. The pick point planar lower surface can include a separate layer of material chosen to enhance the pick performance.

In one embodiment, the strap portion can include an inner edge defining a window designed to engage a palm-confronting portion of a musician's thumb, which can inhibit longitudinal movement of the thumb pick. The strap portion can also include an anti-rotational surface designed to engage a palm-confronting portion of the musician's thumb.

A thumb pick can also be characterized by a unitary one-piece body having a substantially inflexible pick point portion including at least one slot, and a pliable strap portion extending away from the pick point portion toward a tail portion. The pliable strap portion can be designed to wrap around a musician's thumb, while the tail portion can be designed to be engaged in the at least one slot. The tail portion can include a series of grooves and the at least one slot can include a pawl designed to engage at least one of the series of grooves. The pick point portion can include a gusset extending from the slot toward a projecting tip of the pick point. The pick point portion can include a planar lower surface and the gusset can be situated on an upper surface of the pick point portion.

One feature of a thumb pick that includes a gusset on the pick point is the ability to modify the stiffness of the pick point portion through adjustment of the length or other dimension of the gusset. This provides the advantage of allowing each musician to tune the pick to provide the desired feel when used to play a particular instrument.

Other features of the present thumb pick and the corresponding advantages of those features will become apparent from the following discussion of the preferred embodiments of the present thumb pick, exemplifying the best mode of practice, which is illustrated in the accompanying drawings. The components in the figures are not necessarily to scale, emphasis instead being placed upon illustrating the principles of the features. Moreover, in the figures, like referenced numerals designate corresponding parts throughout the different views.

DESCRIPTION OF A PREFERRED EMBODIMENT

Figure 1:
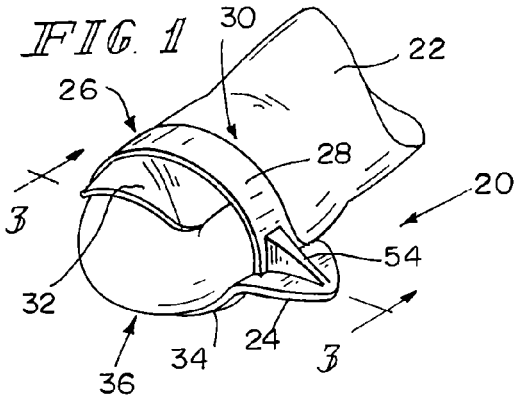
FIG. 1 is a perspective view of a first embodiment of a thumb pick situated on the thumb of a musician.
Figure 2:
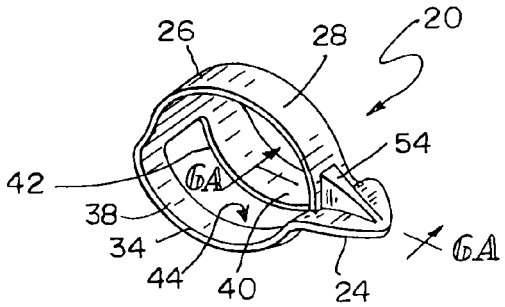
FIG. 2 is a perspective view of the thumb pick shown in FIG. 1 with the musician's thumb removed to provide great clarity.

A first thumb pick 20 is shown in FIG. 1 positioned on a musician's thumb 22. The same thumb pick 20 is shown in FIG. 2 with the musician's thumb 22 removed to provide great clarity. The thumb pick 20 includes a pick point portion 24 and a thumb-engaging portion 26. The thumb-engaging portion 26 is shown to include an upper strap 28 designed to engage an anterior surface 30 of the musician's thumb 22 including the thumb nail 32 and adjacent cuticle. The thumb-engaging portion 26 is also shown to include a lower strap 34 designed to engage a palm-confronting surface 36 of the musician's thumb 22. The lower strap 34 is shown to comprise a distal portion 38 and a proximal portion 40. The distal and proximal portions 38, 40 are shown to include an inner edge 42 defining a window 44 designed to engage the palm-confronting surface 36 of the musician's thumb 22. The window 44 can act to embrace the fleshy palm-confronting surface 36 of the musician's thumb 22 to resist axial movement of the thumb pick 20. Edges 43 and 45 of the window 44 can in a similar manner act to resist any rotational movement of the thumb pick 20, thus enabling the pick to be used in connection with instruments having somewhat stiffer strings and to be played with greater volume. No protrusion, which might interfere with a musician's index finger, is formed on the outer surface at the transition portion 59 unitarily joining the strap portions 28, 38 and 40 opposite the pick point portion 24. Further, the thumb pick point portion 24 can be seen to have a thumb engaging inner surface 57 opposite the pick point portion 24, the thumb engaging inner surface 57 being continuous to smoothly engage the musician's thumb 22 without any gap.

Figure 4:
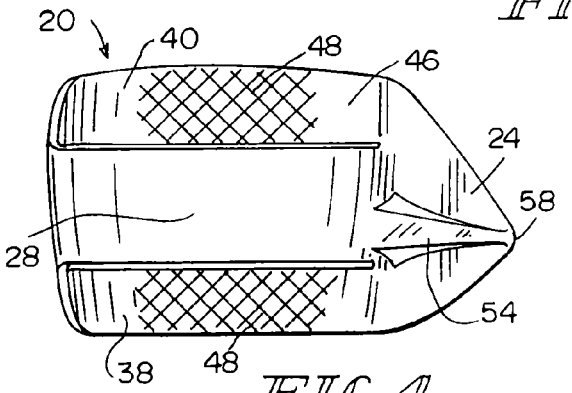
FIG. 4 is a top plan view of the thumb pick shown in FIG. 2.
Figure 5:
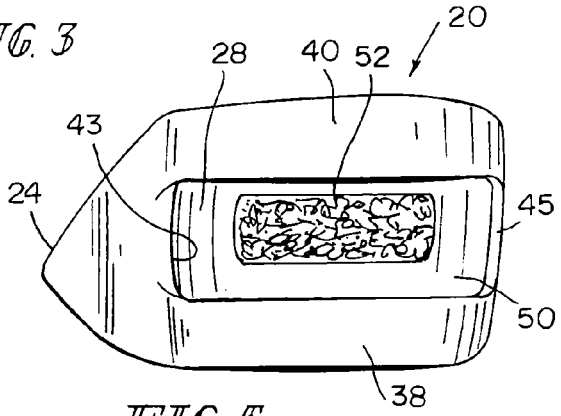
FIG. 5 is a bottom plan view of the thumb pick shown in FIG. 2.

An interior surface 46 of the lower strap portions 38, 40 can include an anti-rotational surface 48 shown in FIG. 4 designed to engage the palm-confronting surface 36 of the musician's thumb 22. An interior surface 50 of the upper strap 28 can also include a cuticle and nail engaging pad 52 shown in FIG. 5. The anti-rotational surfaces 48 can be formed by a knurled or pebbled surface feature formed during or after formation of the straps 34, while the pad 52 will generally be formed separately and added to the interior surface 50 of the upper strap 28. For example, the pad 52 can be formed of a suitably sized segment of material such as the fuzzy loop side of a hook and loop fastener, commonly known as a Velcro® fastener. The surfaces 48, 52 can also be formed by an over-molded material having a higher coefficient of friction than the remaining portions of the thumb pick 20. The over-molded material could also have a softer and more conformable character which would be sufficiently comfortable particularly for the pad 52 engaging any portion of the cuticle adjacent the thumb nail 32.

Figure 3:
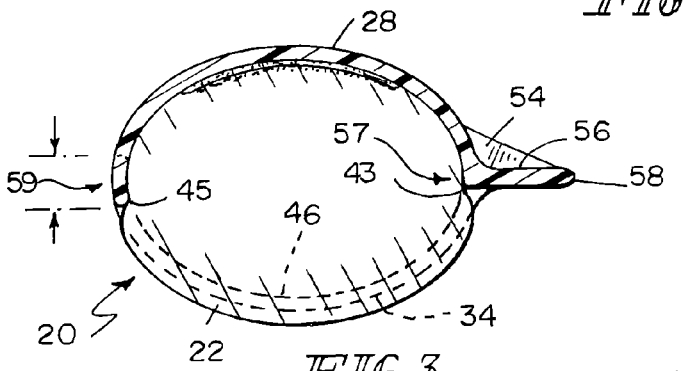
FIG. 3 is a sectional view of the thumb pick taken along line 3-3 of FIG. 1.
Figure 6A:
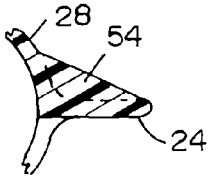
FIG. 6A is a sectional detail view of the pick point portion taken along line 6A-6A of FIG. 2.
Figure 6B:
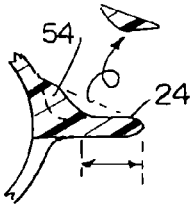
FIG. 6B is the same sectional detail view as FIG. 6A showing a partial removal of the gusset.
Figure 6C:
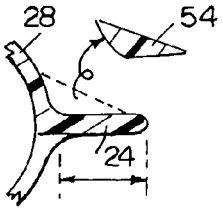
FIG. 6C is the same sectional detail view as FIG. 6A showing a full removal of the gusset.

The pick point portion 24 of the thumb pick 20 can include a gusset 54. The gusset 54 can connect the upper surface 56 of the pick point portion 24 to the upper strap 28. The gusset 54 can be tapered as shown in FIG. 3 from a greater height adjacent to the upper strap 28 down to a lower or even negligible height adjacent to the projecting tip 58 of the pick point portion 24. The gusset 54 can also be tapered as shown in FIG. 4 to have a thickness measured parallel to the plane of the pick point portion 24 that tapers from a greater thickness adjacent to the upper strap 28 down to a smaller thickness adjacent to the projecting tip 58 of the pick point portion 24. The gusset 54 can be unitarily molded with the adjacent upper strap 28 and pick point portion 24 to form a single one-piece element as shown in the cross-sectional view FIG. 6A. The gusset 54 can be partially or totally removed, or otherwise modified by a purchaser to achieve the desired "feel" as illustrated, for example, in FIGS. 6B and 6C.

Figure 7:
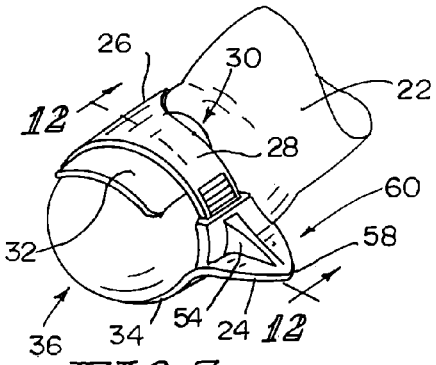
FIG. 7 is a perspective view similar to FIG. 1 of a second embodiment of thumb pick situated on the thumb of a musician.
Figure 8:
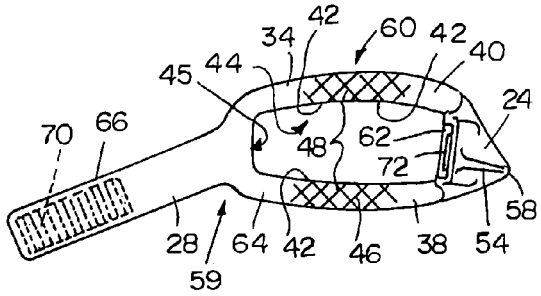
FIG. 8 is a top plan view of the thumb pick shown in FIG. 7 with the pick lying on a substantially flat surface.

A second thumb pick 60 is shown in FIG. 7 positioned on a musician's thumb 22. The thumb pick 60 can include a pick point portion 24 and a thumb-engaging portion 26. The thumb-engaging portion 26 can include an upper strap 28 designed to engage an anterior surface 30 of the musician's thumb 22 including the thumb nail 32 and adjacent cuticle. The thumb pick 60 can be formed as a unitary, essentially planar, one piece molded element in the shape shown in FIG. 8. The thumb pick 60 is preferably sufficiently pliable to be manipulated by hand from the shape shown in FIG. 8 to the shapes shown in FIGS. 9-13. The thumb pick 60 can include the substantially inflexible pick point portion 24, which has a slot 62 as shown in FIG. 8. A pliable strap portion 64 can extend away from the pick point portion toward a tail portion 66. The pliable strap portion 64 can be designed to wrap around a musician's thumb so as to form the lower strap 34 designed to engage a palm-confronting surface 36 of the musician's thumb 22 and the upper strap 28 designed to engage an anterior surface 30 of the musician's thumb 22. The tail portion 66 can be designed to be engaged in the slot 62. The interior surface 48 of the lower strap portions 38, 40 is seen to be continuous with the interior surface 50 of the upper strap 28.

The lower strap 34 can comprise a distal portion 38 and a proximal portion 40. The distal and proximal portions 38, 40 are shown to include an inner edge 42 defining a window 44 designed to engage the palm-confronting surface 36 of the musician's thumb 22. The inner edge 42 of window 44 can act to embrace the fleshy palm-confronting surface 36 of the musician's thumb 22 to resist axial movement of the thumb pick 20. The edges 43 and 45 of window 44 can in a similar manner act to resist any rotational movement of the thumb pick 20. An interior surface 46 of the lower strap portions 38, 40 can include an anti-rotational surface 48 designed to engage the palm-confronting surface 36 of the musician's thumb 22. An interior surface 50 of the upper strap 28 can include an anti-rotational surface in the form of a pad 52 similar to that shown in FIG. 5. The anti-rotational surfaces 48 can be formed by a knurled or pebbled surface feature formed during or after formation of the straps 34. The pad 52 will generally be formed separately and added to the interior surface 50 of the previously formed upper strap 28. The anti-rotational and cushioning surfaces 48, 52 can also be formed by an over-molded material having a higher coefficient of friction than the remaining portions of the thumb pick 20. The over-molded material can also have a softer and more conformable character which may be more comfortable particularly when engaging any portion of the cuticle adjacent the thumb nail 32.

Figure 10:
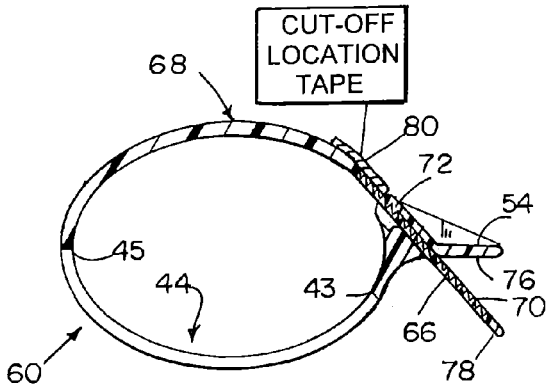
FIG. 10 is a sectional view of the thumb pick shown in FIG. 9 following insertion of the pliable strap tail into and partially through the slot in the pick point portion.

The exterior surface 68 of the straps 28 and 34 is shown to be continuous without any protruding edge that might interfere with a musician's index finger. The exterior surface 68 of the tail portion 66 can include a series of grooves 70, which may extend partially or entirely across the width of the tail portion 66, and which can be saw toothed in cross-sectional shape so as to be unidirectional. A pawl 72 designed to engage at least one of the series of grooves 70 can be positioned adjacent the slot 62 so as to retain the tail portion 66 in the slot 62 as shown, for example, in FIGS. 10-13. The slot 62 can include an opening 74 through a lower surface 76 of the pick point portion 24, which can allow a terminal end 78 the tail portion 66 to protrude below the lower surface 76 as shown in FIG. 10, thus providing a convenient means for adjusting the size of the thumb pick 60 to accommodate thumbs of various dimensions.

Figure 11:
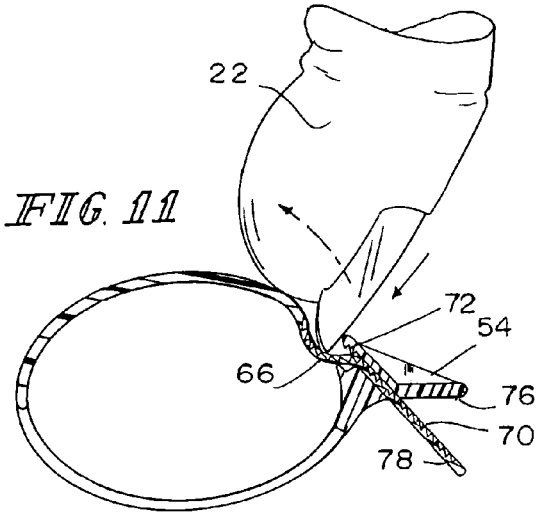
FIG. 11 is a partial sectional view similar to FIG. 10 showing the release of the pliable strap from engagement with the pawl surface located in the slot of the pick point portion.
Figure 12:
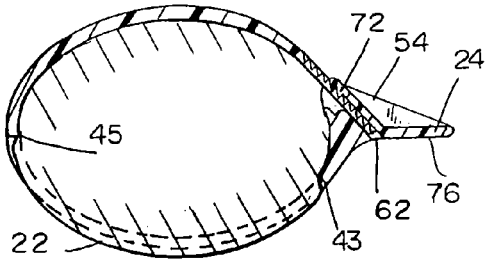
FIG. 12 is a sectional view of the thumb pick shown in FIG. 7 taken along lines 12-12.
Figure 13:
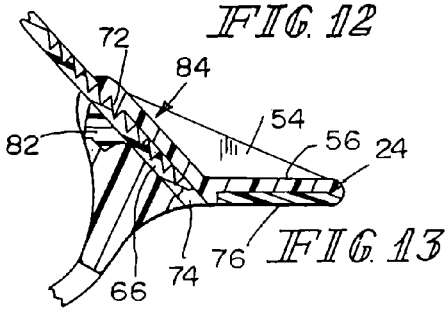
FIG. 13 is a sectional detail view of the pick point portion of FIG. 12 with the added insertion of a keeper to prevent release of the pliable strap from engagement with the pawl surface located in the pick point portion slot.

It will be appreciated that any significant or substantial protrusion of the terminal end 78 below the lower surface 76 would inhibit the lower surface 76 of the thumb pick 60 from contacting any string on a stringed instrument. It is therefore desirable to initially size the thumb pick 60 to accommodate a particular musician's thumb 22 and mark the desired position of the tail portion 66 relative to the slot 62 using a marker 80 such as a piece of tape. The tail portion 66 can then be removed from the slot by applying an inward force on the tail portion 66 as shown in FIG. 11 to permit disengagement of the grooves 70 from the pawl 72. Any undesired terminal end 78 can then be severed from the remainder of the tail portion 66. The tail portion 66 can then be re-inserted into the slot 62 to a position substantially as shown in FIGS. 12 and 13 so that at least one of the plurality of grooves 70 is reengaged by the pawl 72 with the tail portion 66 ending short of or above the lower surface 76 of the pick point portion 24. A locking element such as wedge lock 82 can be inserted opposite the pawl 72 as shown in FIG. 13 to inhibit undesired release of the grooves 70 on tail portion 66 from the pawl 72. The wedge lock 82 can take the form of a preformed wedge of plastic or other material inserted opposite the pawl 72 or a drop of glue or cement securing the tail portion 66 at the desired position.

Figure 9:
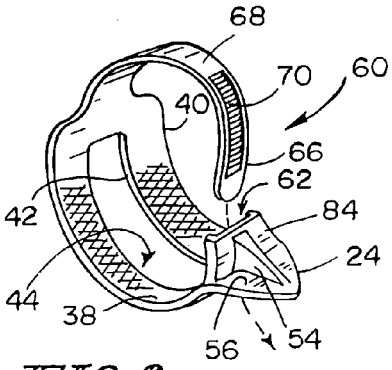
FIG. 9 is a perspective view of the thumb pick shown in FIGS. 7 and 8 with a tail portion of the pliable strap positioned for insertion into the slot in the pick point portion.

The pick point portion 24 of the thumb pick 60 can include a gusset 54. The gusset 54 can connect the upper surface 56 of the pick point portion 24 to an outer surface 84 that is obverse from the pawl 72. The gusset 54 can be tapered as shown in FIG. 10-13 from a greater height adjacent to the upper strap 28 down to a lower or even negligible height adjacent to the projecting tip 58 of the pick point portion 24. The gusset 54 can also be tapered as shown in FIGS. 7-9 to have a thickness measured parallel to the plane of the pick point portion 24 that tapers from a greater thickness adjacent to the surface 84 down to a smaller thickness adjacent to the projecting tip 58 of the pick point portion 24. The gusset 54 can be unitarily molded with the adjacent surface 84 and pick point portion 24 to form a single one-piece element. The gusset 54 can be partially or totally removed, or otherwise modified by a purchaser as illustrated, for example, in FIGS. 6B and 6C to achieve the desired "feel". The lower surface 76 of the pick point portion 24 can include an insert 77 of a material of differing composition from the remainder of the pick point portion 24, the insert material being selected for its hardness, frictional coefficient, or other desirable characteristic.

Figure 9A:
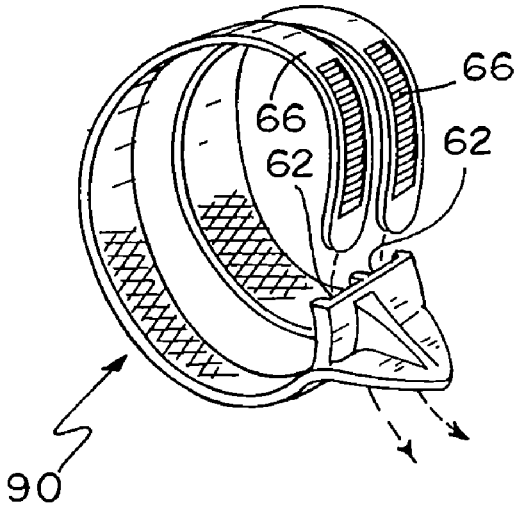
FIG. 9A is a perspective view similar to FIG. 9 of a third embodiment of a thumb pick.

While FIGS. 7-13 illustrate the thumb pick 60 including the pick point portion 24 having a single slot 62 for engaging a single tail portion 66, FIG. 9A illustrates another thumb pick 90 which has a pair of slots 62, each slot designed to receive one of a pair of tail portions 66 in a manner similar to that discussed in connection with FIGS. 7-13. Alternatively, the tail portion 66 of the embodiment shown in FIGS. 7-13 can be bifurcated so that each lower strap portion 38, 40 can be independently tightened to varying amounts with a single pawl 72 engaging the grooves of both bifurcated portions of the tail portion 66. In both embodiments, each of the tail portions 66 can be individually adjusted and terminated as discussed above to arrive at the desired fit on a musician's thumb.

While these features have been disclosed in connection with the illustrated preferred embodiment, other embodiments of the invention will be apparent to those skilled in the art that come within the spirit of the invention as defined in the following claims.

The invention claimed is:

1. A thumb pick comprising a unitary one-piece body having a substantially inflexible pick point portion, and a strap portion extending away from the pick point portion, the strap portion being designed to wrap around a musician's thumb, the strap including a lower portion for engaging the fleshy surface of the musician's thumb and a upper portion for contacting the nail of the musician's thumb, the pick point portion including an outwardly projecting tip designed to engage a string of a stringed instrument, the projecting tip extending outwardly transversely to an axis of the thumb and in a plane that is common to that axis, and a gusset located on and extending upward from an upper surface of the outwardly projecting tip to the strap upper portion to unitarily join the tip to the strap upper portion to provide pick point portion with a desired degree of inflexibility.

2. The thumb pick of claim 1, wherein the strap lower portion includes an inner edge defining a window designed to engage a palm-confronting portion of the musician's thumb.

3. The thumb pick of claim 1, wherein the strap lower portion includes an anti-rotational surface designed to engage a palm-confronting portion of the musician's thumb.

4. The thumb pick of claim 1, wherein the outwardly projecting tip includes a planar lower surface.

5. The thumb pick of claim 4, wherein the gusset has a height measured from the lower surface of the outwardly projecting that tapers from a greater height adjacent to the strap portion down to a lower height adjacent to the projecting tip of the pick point.

6. The thumb pick of claim 4, wherein the gusset has a thickness measured parallel to the lower surface of the outwardly projecting tip that tapers from a greater thickness adjacent to the strap portion down to a smaller thickness adjacent to the projecting tip of the pick point.

7. A thumb pick comprising a unitary one-piece body having a substantially inflexible pick point portion having a lower surface defining a plane that is common with an axis of the thumb and including at least one slot opening through the pick point portion to the plane, and a pliable strap portion extending away from the pick point portion toward a tail portion, the pliable strap portion being designed to wrap around a musician's thumb, the tail portion being designed to pass through the plane and be received in the at least one slot.

8. The thumb pick of claim 7, wherein the tail portion includes a series of grooves and a pawl is situated adjacent to the at least one slot to engage at least one of the series of grooves.

9. The thumb pick of claim 8, wherein the tail portion including the series of grooves is bifurcated with each bifurcated portion being independently engageable in the pawl adjacent to the at least one slot.

10. The thumb pick of claim 7, wherein the pick point portion includes a single gusset extending from the at least one slot toward an outwardly projecting tip of the pick point to provide the pick point portion with a desired degree of inflexibility.

11. The thumb pick of claim 10, wherein the gusset is situated on an upper surface of the outwardly projecting tip.

12. The thumb pick of claim 11, wherein the gusset has a height measured from the lower surface of the outwardly projecting tip that tapers from a greater height adjacent to the strap portion down to a lower height adjacent to the projecting tip of the pick point.

13. The thumb pick of claim 11, wherein the gusset has a thickness measured parallel to a lower surface of the outwardly projecting tip that tapers from a greater thickness adjacent to the strap portion down to a smaller thickness adjacent to the projecting tip of the pick point.

14. The thumb pick of claim 7, wherein the pliable strap portion includes an inner edge defining a window designed to engage a palm-confronting portion of the musician's thumb.

15. The thumb pick of claim 7, wherein the pliable strap portion includes an anti-rotational surface designed to engage a palm-confronting portion of the musician's thumb.

16. The thumb pick of claim 7, wherein the at least one slot includes a plurality of slots and the pliable strap portion includes a plurality of tails, each tail designed to engage one of the plurality of slots.

17. A thumb pick comprising a unitary one-piece body having a substantially inflexible pick point portion including at least one slot, and a pliable strap portion extending away from the pick point portion toward a tail portion, the pliable strap portion being designed to wrap around a musician's thumb, the tail portion being designed to be engaged in the at least one slot, wherein the tail portion includes a series of grooves and a pawl is situated adjacent to the at least one slot to engage at least one of the series of grooves, and wherein the tail portion includes a separable wedge lock portion designed to be inserted into a space opposite the pawl to secure the pliable strap portion at a fixed position engaging the pawl.

18. A thumb pick comprising a unitary one-piece body having a substantially inflexible pick point portion having a lower surface defining a plane that is common with an axis of the thumb and including at least one slot extending between an upper surface and a lower surface of the pick point portion, and a pliable strap portion extending away from the pick point portion toward a tail portion including a terminal end, the pliable strap portion being designed to wrap around a musician's thumb, the tail portion including a series of grooves, the tail portion being engaged in the at least one slot with the tail portion positioned between the upper and lower surfaces of the pick point portion, a pawl situated adjacent to the at least one slot to engage, and to permit selective disengagement of the pawl from, at least one of the series of grooves.

19. The thumb pick of claim 17, wherein the pliable strap portion includes an anti-rotational surface.

20. A thumb pick comprising a unitary one-piece body having a pick point portion and a strap portion designed to wrap around a musician's thumb, the pick point portion including a string engaging outer surface including a projecting tip and a thumb engaging inner surface, the thumb engaging inner surface being opposite the string engaging outer surface and continuous to smoothly engage the musician's thumb without any gap, the projecting tip extending outwardly transversely to an axis of the thumb and in a plane that is common to that axis and a gusset located on and extending upward from an upper surface of the projecting tip to an upper strap portion to unitarily join the projecting tip to the upper strap portion, thereby providing a desired degree of inflexibility.

21. The thumb pick of claim 20, wherein the strap portion includes a three strap configuration with a pair of the three straps being connected unitarily to a lower surface of the pick point portion and another of the three straps being connected unitarily to an upper surface of the pick point portion, a transition portion unitarily coupling the three straps at a position opposite the pick point portion.

* * * * *